US006122598A

United States Patent [19]

Tanaka et al.

[11] Patent Number: 6,122,598

[45] Date of Patent: Sep. 19, 2000

[54] MEASUREMENT AND DISPLAY OF LOAD OF EXCAVATING BLASTED GROUND

[75] Inventors: Yasuo Tanaka, Tsukuba; Yutaka Watanabe; Yoshinori Furuno, both of Tsuchiura; Takashi Yagyu, Ushiku; Yukihiko Sugiyama, Tsuchiura, all of Japan

[73] Assignee: Hitachi Construction Machinery Co., Ltd., Tokyo, Japan

[21] Appl. No.: 09/065,064

[22] PCT Filed: Aug. 26, 1997

[86] PCT No.: PCT/JP97/02968

§ 371 Date: May 27, 1998

§ 102(e) Date: Apr. 27, 1998

[87] PCT Pub. No.: WO98/09026

PCT Pub. Date: Mar. 5, 1998

[30] Foreign Application Priority Data

Aug. 26, 1996 [JP] Japan ..... 8-223813

[51] Int. Cl.[7] ..... G06F 19/00

[52] U.S. Cl. ..... 702/5; 702/182; 299/30

[58] Field of Search ..... 702/2, 5, 14, 16, 702/182, 184; 701/50; 299/13, 29, 30; 102/302, 311

[56] References Cited

U.S. PATENT DOCUMENTS

| | | | |
|---|---|---|---|
| 4,919,222 | 4/1990 | Kyrtsos et al. | 177/139 |
| 5,105,896 | 4/1992 | Kyrtsos . | |
| 5,404,661 | 4/1995 | Sahm et al. | 701/50 |
| 5,438,771 | 8/1995 | Sahm et al. . | |
| 5,535,532 | 7/1996 | Fujii et al. | 701/50 |
| 5,553,407 | 9/1996 | Stump | 701/50 |
| 5,806,016 | 9/1998 | Henderson et al. | 701/50 |
| 5,844,800 | 12/1998 | Brandt et al. | 700/97 |
| 5,850,341 | 12/1998 | Fournier et al. | 701/207 |
| 5,968,103 | 10/1999 | Rocke | 701/50 |

FOREIGN PATENT DOCUMENTS

| | | |
|---|---|---|
| 0 110 399 | 6/1984 | European Pat. Off. . |
| 0 229 083 | 7/1987 | European Pat. Off. . |
| 195 10 375 | 9/1995 | Germany . |

OTHER PUBLICATIONS

Hendricks, Peck, Scoble, An Automated Approach to Blast Optimization Through Preformance Monitoring of Blast Hole Drills and Mining Shovels, Jun. 1992, pp. 1–69.

*Primary Examiner*—Donald E. McElheny, Jr.
*Attorney, Agent, or Firm*—Evenson, McKeown, Edwards & Lenahan, P.L.L.C.

[57] ABSTRACT

This invention relates to a measuring and display system for loads applied upon digging blasted earth, which can contribute to accurate blasting. An operating direction of a bucket of an excavator is detected by pressure switches 15,16, while a pressure $P_B$ in a bottom compartment 6$S_B$ of a bucket cylinder is detected by a pressure sensor 17. A processor 23 computes a digging position based on signals from a boom angle sensor 18, an arm angle sensor 19, GPS 20 and a magnetic direction sensor 21, integrates pressures $P_B$ during an ON period of the pressure switch 15, and transmits the thus-integrated pressure together with the digging position to a computer 30. The computer 30 displays a map of a lot under blasting and blasting positions on a display, and on the map, also displays the thus-transmitted digging position by a mark X and the integrated pressure by a numeral. With reference to this integrated pressure, a determination is made as to whether the blasting was proper or improper. The results of this determination are used for the next blasting.

13 Claims, 15 Drawing Sheets

6S: BUCKET CYLINDER
12: CONTROL VALVE
13: OPERATING LEVER
14: PILOT VALVE
15, 16: PRESSURE SWITCHES
17: PRESSURE SENSOR
21: MAGNETIC DIRECTION SENSOR
22: START/STOP SWITCH
24, 31: RADIO TRANSMITTER/RECEIVERS

MEASUREMENT AND DISPLAY OF LOAD OF EXCAVATING BLASTED GROUND

TECHNICAL FIELD

This invention relates to a measuring and display system for loads applied upon digging blasted earth, which measures and displays loads applied upon digging earth by an excavator subsequent to blasting in a large-scale mine or the like.

BACKGROUND ART

According to a mining method adopted in a large-scale open-pit (surface) mine or the like, earth is broken up beforehand by blasting, followed by the digging of this broken-up earth with an excavator, for example, a hydraulic shovel. This will be described with reference to FIGS. 19, 20 and 21. FIG. 19 is a plan view of the entirety of a large-scale mine. In this drawing, letter A indicates the whole area of the large-scale mine, which is as wide as several kilometers or longer in both length and width. Designated at signs $A_1$–$A_n$ are lots formed by dividing the whole area A into smaller sections. Each lot is set so that it is about 50 to 200 m in both length and width. Letter B indicates a mine management office which performs management of this mine site. The mine management office B is built at a position which is convenient for the management of both the inside and outside of the whole area A.

FIG. 20 is a plan view of one of the lots shown in FIG. 19. In this case, the lot $A_1$ depicted in FIG. 19 is shown in the form of a square. Signs $P_{B1}$,$P_{B2}$, . . . , $P_{Bi}$, . . . indicate blasting positions in the area $A_1$. Further, signs $d_1$,$d_2$ indicate distances between the respective explosives. In general, these distances are often set substantially equal. The placement positions (distances) and amounts of explosives are determined in view of cylindrical samples, which are obtained by conducting a geological survey at predetermined positions in the whole area A, and a topographical map of the whole area.

FIG. 21 is a side view of a hydraulic shovel. After completion of blasting by explosives placed in a lot, one or more hydraulic shovels enter the lot to dig the blasted earth and then to load it on dump trucks or the like. The blasted earth is transported to a predetermined place and is processed there. The hydraulic shovel illustrated in FIG. 21 performs this digging work. In the drawing, there are shown a travel base 1, a pivot cab 2, a cab 3, a boom 4 pivotally supported on the pivot cab 2, a boom cylinder 4S for driving the boom 4, an arm 5 pivotally supported on the boom 4, an arm cylinder 5S for driving the arm 5, a bucket 6 turnably supported on the arm 5, a bucket cylinder 6S for driving the bucket 6, and a hinge **6*p* as a center line of turning motion of the bucket. Letters C and D indicate a crowding direction and a dumping direction, respectively, in the operation of the bucket. Digging is performed when the bucket 6 is operated in the crowding direction C, whereas release of dug earth from the bucket is performed when the bucket 6** is operated in the dumping direction D.

Upon completion of the above-described digging work in one of the lots, explosives are next planted in the next lot. These explosives are fired, and the blasted earth is dug by the hydraulic shovels. The dug earth is transported away by dump trucks or the like. Digging work of the individual lots is successively performed in the manner as described above.

The removal of overburden is considered to account for 80% of the above-described work in the large-scale mine. Accordingly, whether blasting is proper or improper has an overwhelming influence on the entire work. Described specifically, use of explosive in unduly small amounts or setting of blasting positions at excessively large distances makes it impossible to break up earth sufficiently loosely. In this case, large digging loads are applied to the hydraulic shovels. More time is therefore spent digging, resulting in the digging not being able to be performed as scheduled. This also leads to an inconvenience in that dump trucks are kept on standby for a long time. On the other hand, use of explosive in excessively large amounts or setting of blasting positions at excessively small distances results in excessively loose breakage of earth. This leads not only to a problem of the digging ability of the hydraulic shovels not being able to be used fully but also to another problem of cost for the explosive being substantial. A blasting planner makes a blasting plan for the next lot by observing the state of earth after the blasting or by learning of the state of digging from the operators of the hydraulic shovels. Both this observation and learning rely upon the sensations of the planner and those of the operators, respectively, thereby making it impossible to perform optimal blasting in many instances.

An object of the present invention is to provide a measuring and display system for loads applied upon digging blasted earth, which can solve the above-described inconveniences and problems of the conventional art and can contribute to accurate blasting.

DISCLOSURE OF THE INVENTION

To achieve the above-described object, the invention of claim 1 features the construction of a measuring system for loads, which are applied upon digging blasted earth, by crowding operation detecting means for detecting a crowding operation of a bucket of an excavator which is in a digging operation of earth after blasting and pressure detection means for detecting, as a digging load, a bottom pressure of a bucket cylinder of the excavator upon detection of the crowding operation by the crowding operation detecting means.

The invention of claim 2 features the inclusion of digging time detection means for detecting digging time of the excavator in the measuring system of claim 1.

The invention of claim 3 features the construction of a measuring system for loads, which are applied upon digging blasted earth, by crowding operation detecting means for detecting a crowding operation of a bucket of an excavator which is in a digging operation of earth after blasting; loading step determination means for determining a loading step performed by the excavator, pressure detection means for detecting, as a digging load, a bottom pressure of a bucket cylinder of the excavator upon detection of the crowding operation by the crowding operation detecting means, and classification means for classifying the digging load, which has been detected by the pressure detection means, as the digging load in the loading step as determined by the loading step determination means or as a digging load in a step other than the loading step.

The invention of claim 4 features the construction of a measuring system for loads, which are applied upon digging blasted earth, by crowding operation detecting means for detecting a crowding operation of a bucket of an excavator which is in a digging operation of earth after blasting, and preset pressure detection means for detecting, as a digging load, a bottom pressure of a bucket cylinder of the excavator when the bottom pressure arises at least to a preset pressure while the crowding operation is being detected by the crowding operation detecting means.

The invention of claim 5 features the inclusion of load quantity detection means, which is for determining the time or number of detections in each of which a pressure at least equal to the preset pressure is detected by the preset pressure detection means, in the measuring system of claim 4.

The invention of claim 6 features that, in the measuring system according to claim 1 or 2, a display system for loads applied upon digging blasted earth is constructed by arranging digging position detecting means for detecting a digging position by the excavator and display means for displaying the digging load detected by the pressure detection means or a value or color corresponding to the digging load and the digging position detected by the digging position detecting means.

The invention of claim 7 features that, in the measuring system according to claim 3, a display system for loads applied upon digging blasted earth is constructed by arranging digging position detecting means for detecting a digging position by the excavator and display means for displaying the digging load, which has been detected by the pressure detection means or a value or color corresponding to the digging load, while specifying whether the digging load or the value or color is one in the loading step or one in the step other than the loading step as determined by the loading step determination means, and the digging position detected by the digging position detecting means.

The invention of claim 8 features that, in the measuring system according to claim 5, a display system for loads applied upon digging blasted earth is constructed by arranging digging position detecting means for detecting a digging position by the excavator and display means for displaying the time or number, which has been detected by the load quantity detection means, or a color corresponding to the time or number, and the digging position detected by the digging position detecting means.

BEST MODES FOR CARRYING OUT THE INVENTION

Figure 1:
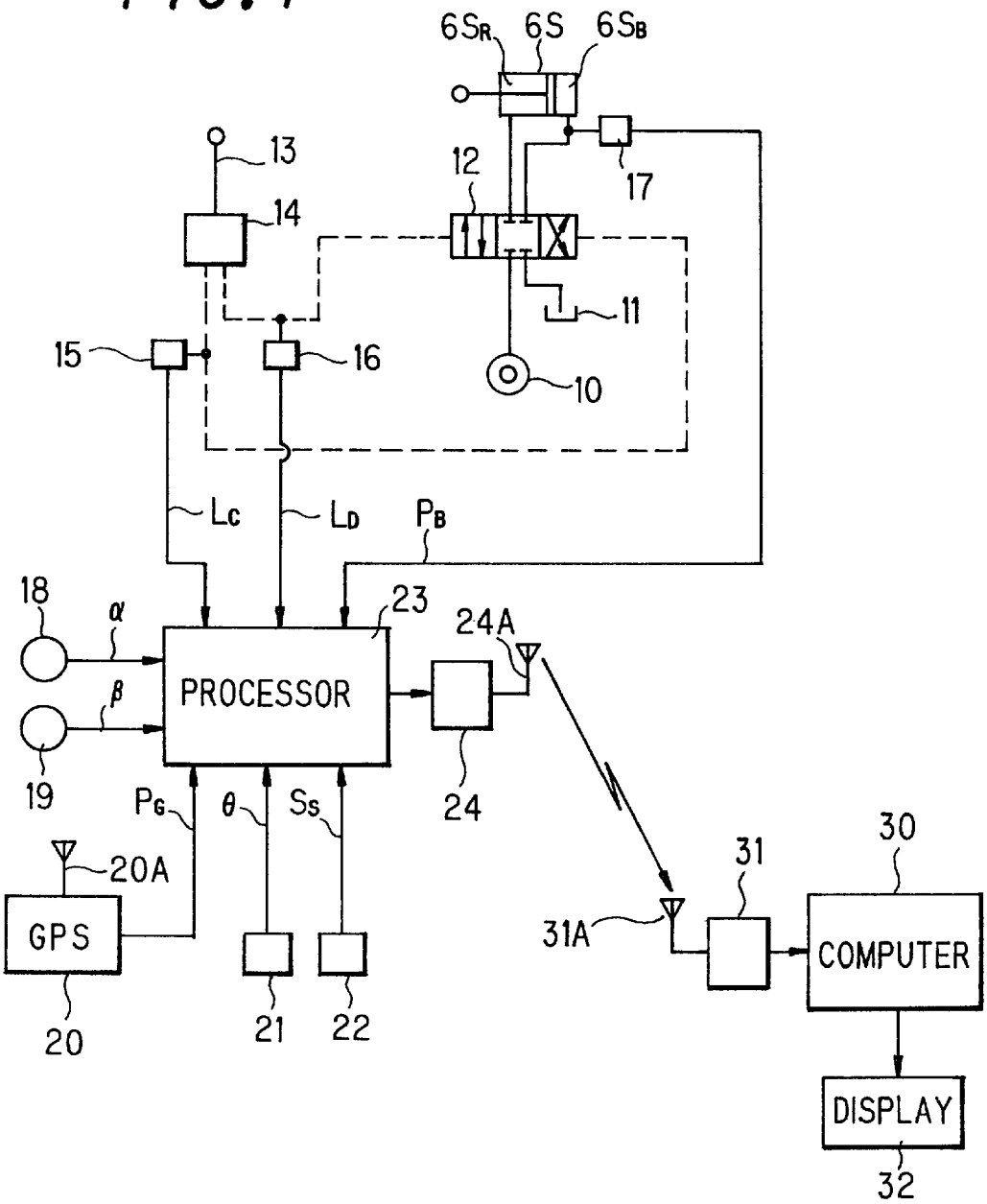
FIG. 1 is a block diagram of a measuring and display system according to a first embodiment of the present invention for loads applied upon digging blasted earth.

The present invention will hereinafter be described based on the embodiments illustrated in the drawings.

FIG. 1 is the block diagram of the measuring and display system according to the first embodiment of the present invention for loads applied upon digging blasted earth. In the diagram, there are shown the bucket cylinder 21 depicted in FIG. 21, a rod compartment $6S_R$ of the bucket cylinder 6S, and a bottom compartment $6S_B$. Also illustrated are a hydraulic pump 10 for the hydraulic shovel, a reservoir 11, a control valve 12 interposed between the hydraulic pump 10 and the bucket cylinder 6S, and an operating lever 13 for the bucket 6. Numeral 14 indicates a pilot valve, which according to an operation of the operating lever 13, supplies a pilot pressure to the control valve 12 to drive the control valve 12. Designated at numeral 15 is a pressure switch, which is adapted to detect an operation of the bucket 6 in a crowding direction by the operating lever 13 and which outputs a signal $L_C$ when the operating lever 13 is operated in the crowding direction. Designated at numeral 16 is another pressure switch, which is adapted to detect an operation of the bucket 6 in a dumping direction by the operating lever 13 and which outputs a signal $L_D$ when the operating lever 13 is operated in the dumping direction. Numeral 17 indicates a further pressure sensor for detecting a pressure $P_B$ in the bottom compartment $6S_B$ of the bucket cylinder 6S. Also depicted are an angle sensor for detecting a boom angle $\alpha$ of the hydraulic shovel and another angle sensor for detecting an arm angle $\beta$ of the hydraulic shovel.

Figure 2:
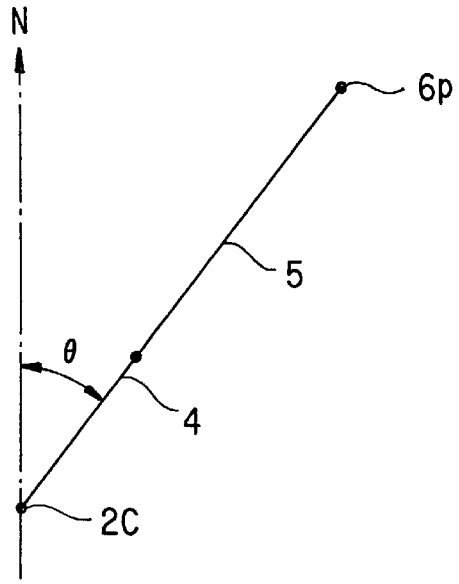
FIG. 2 is a diagram illustrating a direction of a magnetic direction sensor.

Numeral 20 indicates GPS (Global Positioning System) mounted on the hydraulic shovel, which receives signals at an antenna 20A from a satellite and outputs an absolute coordinate $P_G$ of the hydraulic shovel on the earth. Designated at numeral 21 is a magnetic direction sensor arranged on a center line of revolving motion of the pivot cab 2 of the hydraulic shovel. Referring to FIG. 2, a description will be made of a direction detected by the magnetic direction sensor. In FIG. 2, there are shown the center line 2C of revolving motion of the pivot cab 2 and axes 4,5 of the boom 4 and arm 5, said axes being indicated by solid lines. Sign 6*p* indicates a hinge as a center line of turning motion of the bucket. The magnetic direction sensor 21 is adapted to detect how many degrees the forward direction of the pivot cab 2, that is, the direction of each of the boom 4, arm 5 and bucket 6 is inclined from northward of the geomagnetism, and the angle so detected is indicated by letter $\theta$ in FIG. 2 and is outputted as direction data. Designated at numeral 22 is a start/stop switch, which the hydraulic shovel is equipped with and, when operated, outputs a signal $S_S$. The signal $S_S$ can be either a signal indicating turning-on of the start switch or a signal indicating turning-on of the stop switch. Numeral 23 indicates a processor mounted on the hydraulic shovel and composed of a computer (the construction of this processor will be described subsequently herein), and numeral 24 indicates a radio transmitter/receiver equipped with an antenna 24A.

Figure 19:
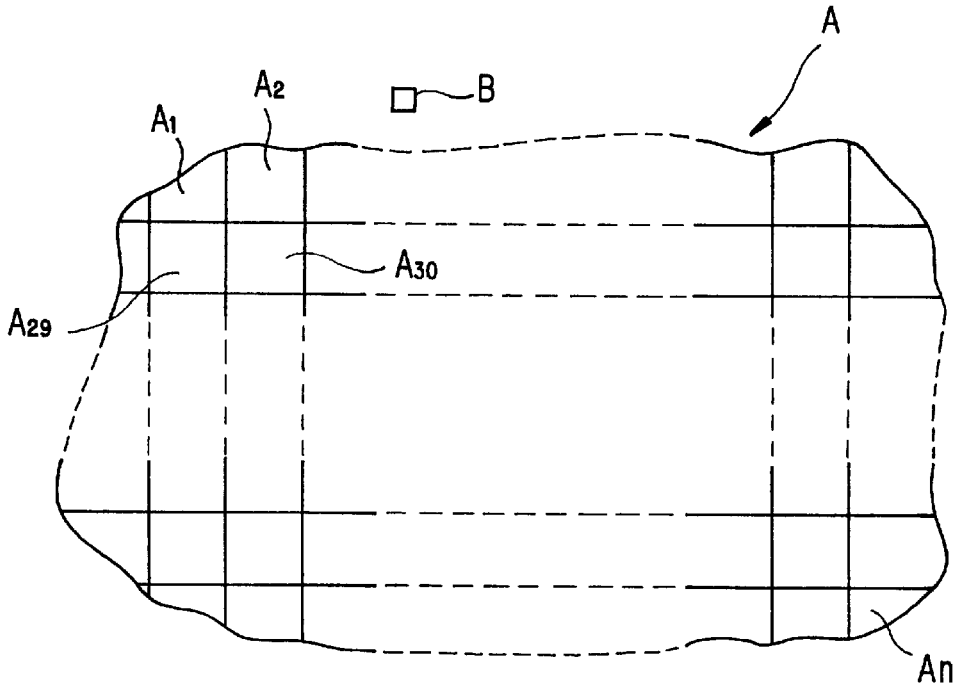
FIG. 19 is a plan view of the entirety of the large-scale mine.
Figure 20:
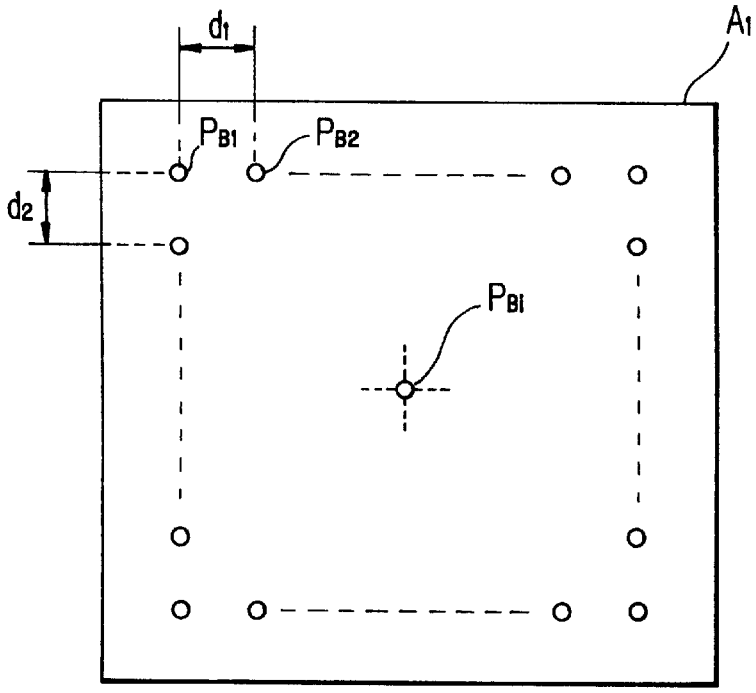
FIG. 20 is a plan view of the single lot shown in FIG. 20.

Designated at numeral 30 is a computer installed in the mine management office B shown in FIG. 19. Numeral 31 indicates a radio transmitter/receiver, which is equipped with an antenna 31A and receives various data, which has been outputted from the processor 23, via the radio transmitter/receiver 24. Designated at numeral 32 is a display for performing a desired display on the basis of data from the computer 30.

Figure 3:
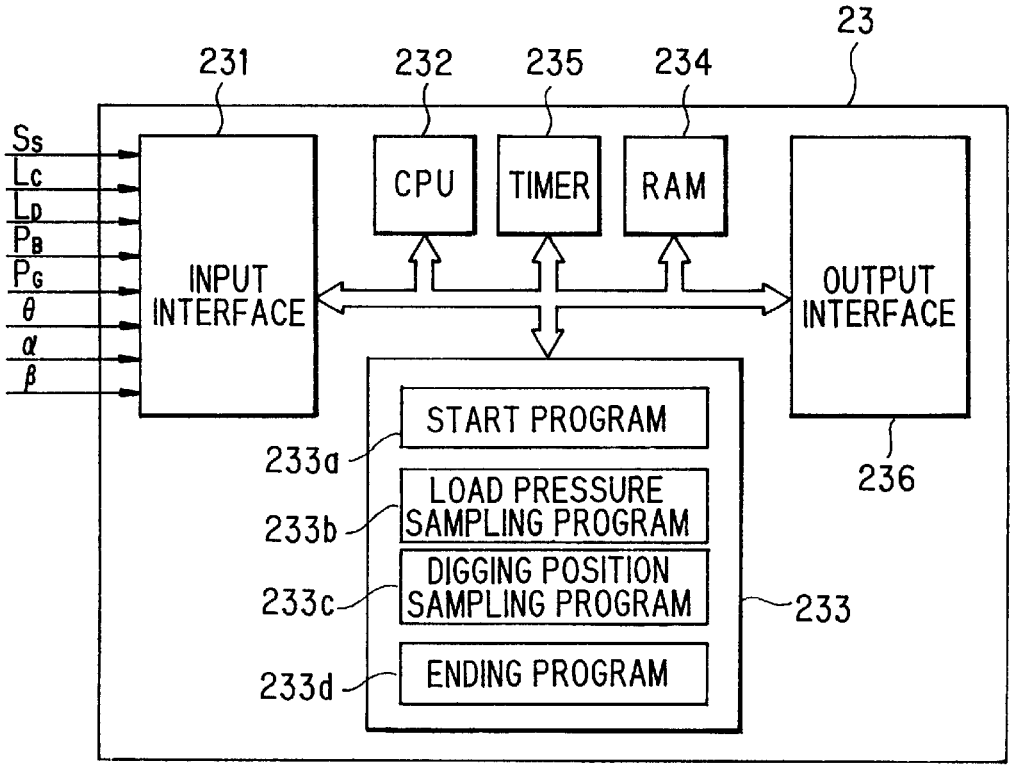
FIG. 3 is a system configuration diagram of a processor depicted in FIG. 1.

FIG. 3 is the system configuration diagram of the processor 23 depicted in FIG. 1. In the diagram, numeral 23 indicates the processor. Numeral 231 indicates an input interface 231, through which individual signals shown in FIG. 1 are inputted, and is equipped with an A/D converter. Also illustrated are a central processing unit (CPU) 232 for performing various computation and control, a read-only memory (ROM) 233 for storing therein processing programs and the like for CPU 232, a random access memory (RAM) for storing therein the results and the like of computation and control, a timer 235 for outputting time signals, and an output interface 236 through which data, which has been obtained at the processor 23, is outputted. Stored in ROM 233 are included a start/stop program 233*a*, a load pressure sampling program 233*b*, a digging position sampling program 233*c*, and an ending program 233*d*.

Figure 4:
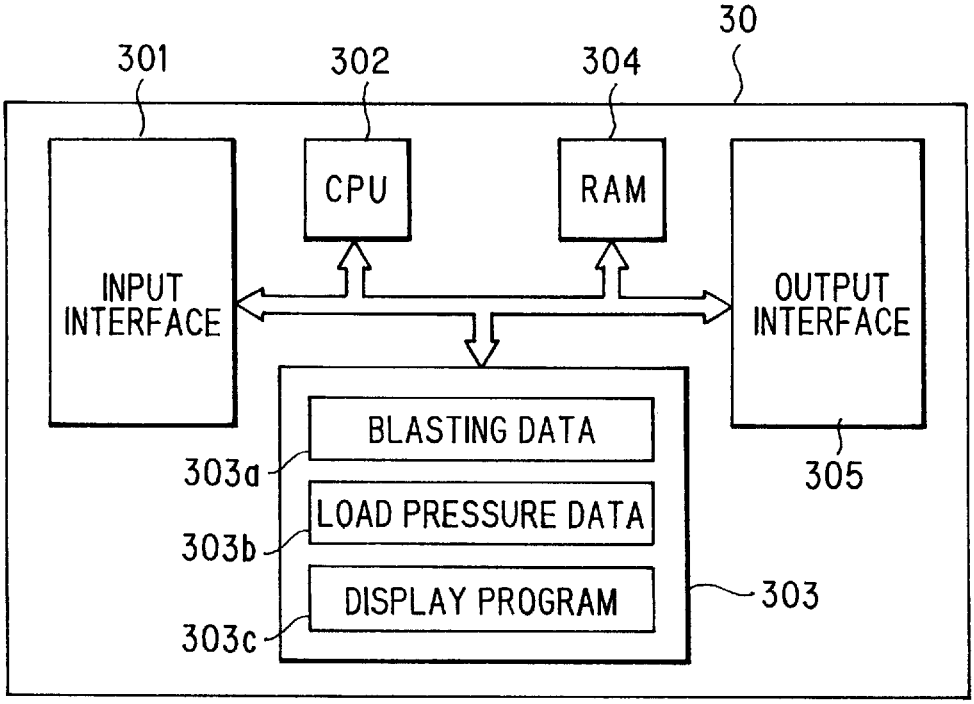
FIG. 4 is a system configuration diagram of a computer shown in FIG. 1.

FIG. 4 is the system configuration diagram of the computer 30 shown in FIG. 1. In the diagram, numeral 30 indicates a computer. Also illustrated are an input interface 301 through which signals are inputted from the radio transmitter/receiver shown in FIG. 1, a central processing unit (CPU) 302 for performing various computation and control, a read-only memory (ROM) 303 for storing therein processing programs and the like for CPU 302, a random access memory (RAM) 304 for storing therein the results of computation and control, and an output interface 305 through which data obtained at the computer 30 is outputted. Stored in ROM 303 include blasting data 303*a*, load pressure data 303*b*, and a display program 303*c*. The blasting data 303*a* consists of a map of a digging work site, planted positions of explosives, and amounts of the explosives.

Operation of this embodiment will next be described with reference to the flow charts of FIG. 5 through FIG. 10. Upon digging earth subsequent to the completion of blasting, a hydraulic shovel operator turns on the start switch of the start/stop switch 22 so that a signal $S_S$ is outputted. CPU 232 of the processor 23 monitors an input of the signal $S_S$ in accordance with the start program 233*a* shown in FIG. 5 (Step $S_{10}$) and, when the signal $S_S$ is inputted, sets a digging counter n, a lever-operated time counter $C_{TL}$ of the operating lever 13 and an integrated value $P_D$ of pressures $P_B$ detected by the pressure sensor 17 at 0, respectively, and turns off a crowd flag $F_C$ and a dump flag $F_D$ (step $S_{11}$), whereby the start program is ended.

Figure 6:
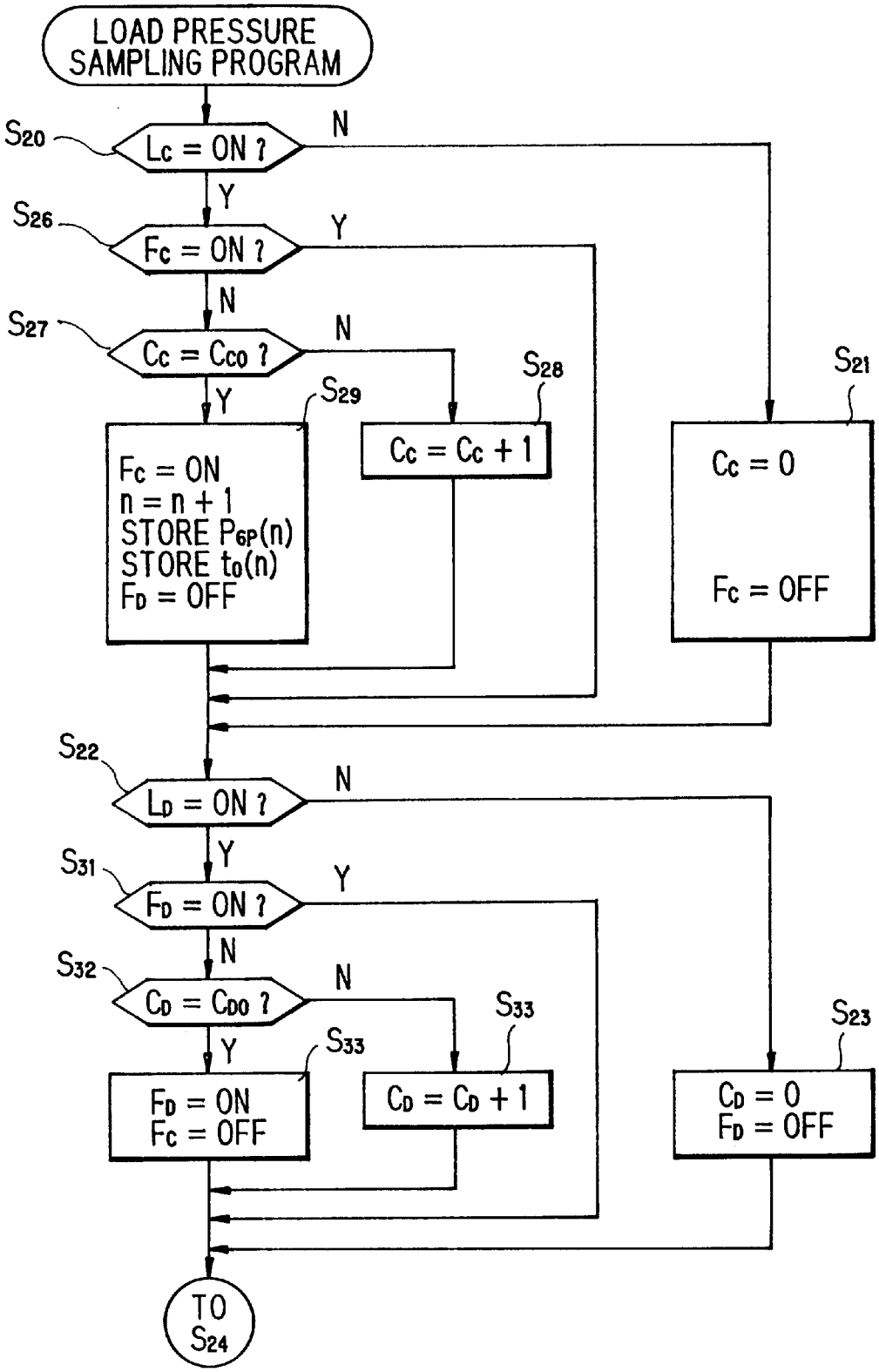
FIG. 6 is another flow chart illustrating another operation of the system shown in FIG. 1.
Figure 7:
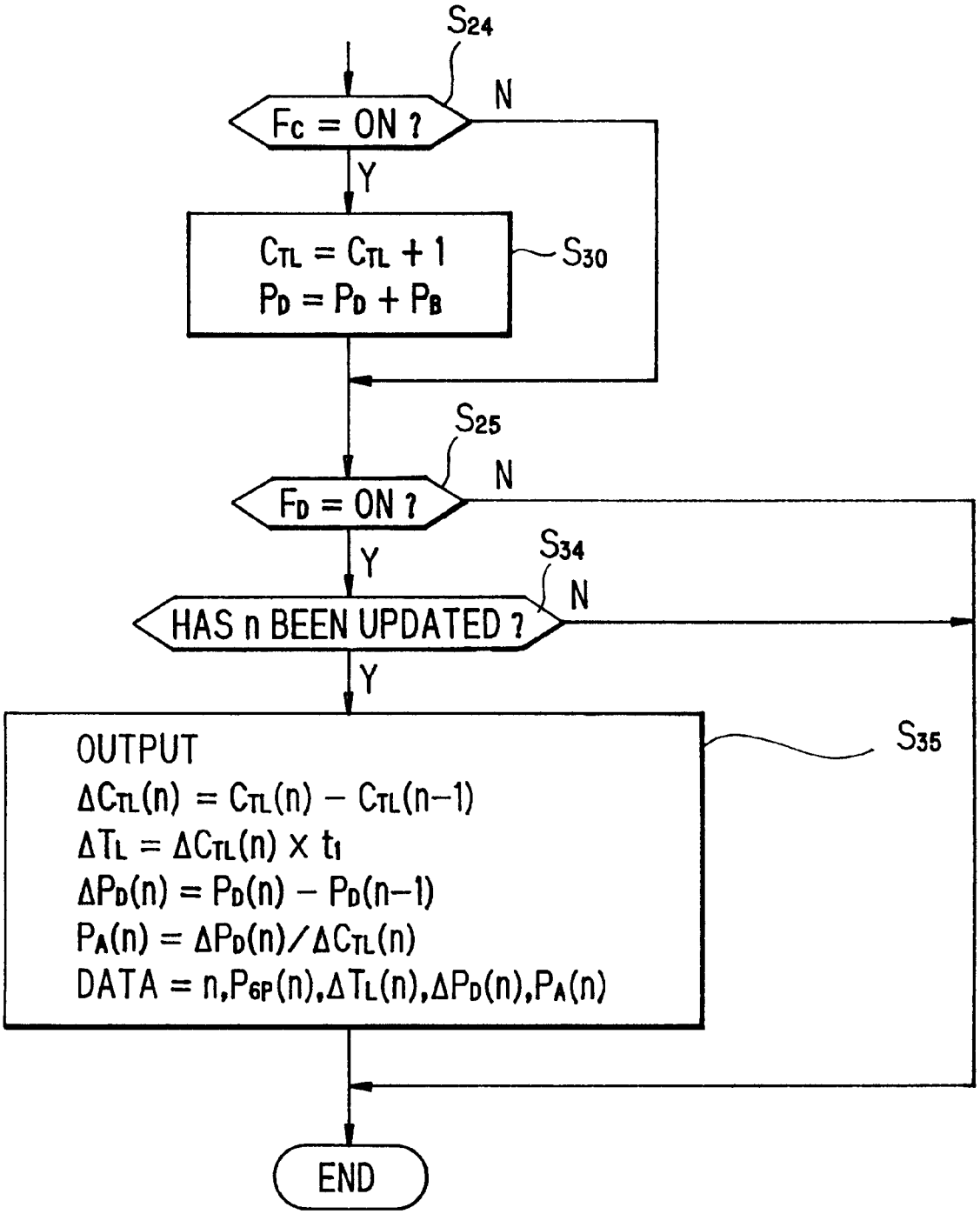
FIG. 7 is a further flow chart illustrating a further operation of the system shown in FIG. 1.

Based on an output from the timer 235, CPU 232 next activates the load pressure sampling program 233*b*, which is shown in FIG. 6 and FIG. 7, for example, at intervals of 10 msec. When the operating lever 13 is operated in the direction to crowd the bucket 6 (in other words, when digging is performed), this load pressure sampling program, in order to confirm that an operation signal $L_C$ is not a noise but is a reflection of the operator's intention, determines whether or not the signal has been inputted continuously for a predetermined time, for example, for 0.3 sec. When the signal is confirmed to have lasted for the predetermined time, it is determined that digging has been performed. Similar confirmation is also performed with respect to an operation signal $L_D$ which is outputted when earth is dumped subsequent to the completion of the digging. Further, when these confirmations have been made, an operation is performed for the first time to set predetermined values, respectively, and to input them.

Figure 5:
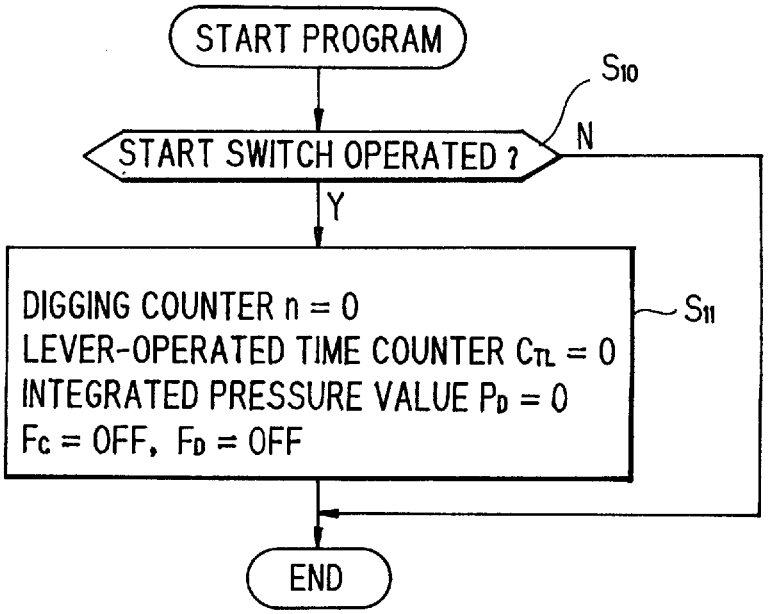
FIG. 5 is a flow chart illustrating an operation of the system shown in FIG. 1.

When the load pressure sampling program 233*b* is activated subsequent to the performance of the start program shown in FIG. 5, CPU 232 determines whether or not the operation signal $L_C$, which indicates the operation of the operating lever 13 in the crowding direction, has been inputted (step $S_{20}$ shown in FIG. 6). When the signal is not determined to have been inputted, a crowding-operation-determining counter value $C_C$ is set at 0 and the crowd flag is turned off (step $S_{21}$), followed by the determination as to whether or not the operating signal $L_D$ indicating operation of the operating lever 13 in the dumping direction has been inputted (step $S_{22}$). When the signal is not determined to have been inputted, a damping-operation-determining counter value $C_D$ is set at 0 and the dump flag is turned off (step $S_{21}$). The processing is then continued to step $S_{24}$ shown in FIG. 7, where a determination is made as to whether or not the crowd flag $F_C$ is ON. If it is not ON, it is likewise determined whether or not the dump flag is ON (step $S_{25}$). If it is not ON, the processing is ended.

When the operator operates the operating lever 13 in the crowding direction to perform digging while such processing is performed at intervals of 10 msec, this operation is determined by the processing in step $S_{20}$, and CPU 232 then determines whether or not the crowd flag is ON (step $S_{26}$). As the crowd flag has not been turned on in this case, it is determined whether or not the crowding-operation-determining counter value $C_C$ has reached a predetermined value $C_{CO}$ (step $S_{27}$). Assuming that the value $C_{CO}$ is 30 times, for example, it takes 0.3 sec until the crowding-operation-determining counter value $C_C$ increases from 0 to 30 because the load pressure sampling program 233*b* is executed at intervals of 10 msec in the above-described example. Within this time, the operator's intention of the operation is confirmed.

Described specifically, when the crowding-operation-determining counter value $C_C$ has not reached the predetermined value $C_{CO}$, "1" is added to the crowding-operation-determining counter value $C_C$ (step $S_{28}$) and the routine proceeds through steps $S_{22}$, $S_{23}$, $S_{24}$ and $S_{25}$, whereby the processing is ended. When this processing is repeated at intervals of 10 msec, the crowding-operation-determining counter value $C_C$ eventually reaches the value $C_{CO}$. By determining this as a result of the processing in step $S_{27}$, CPU 232 confirms that the operator has operated the operating lever 13 in the crowding direction. CPU 232 turns on the crowd flag, adds "1" to the digging counter n, stores a current digging position $P_{6P}$ (the current position of the hinge 6*p*) and also a current time, and turns off the dump flag (step $S_{29}$). The routine then proceeds through steps $S_{22}$, $S_{23}$, $S_{24}$ and $S_{25}$, whereby the processing is ended.

Figure 8:
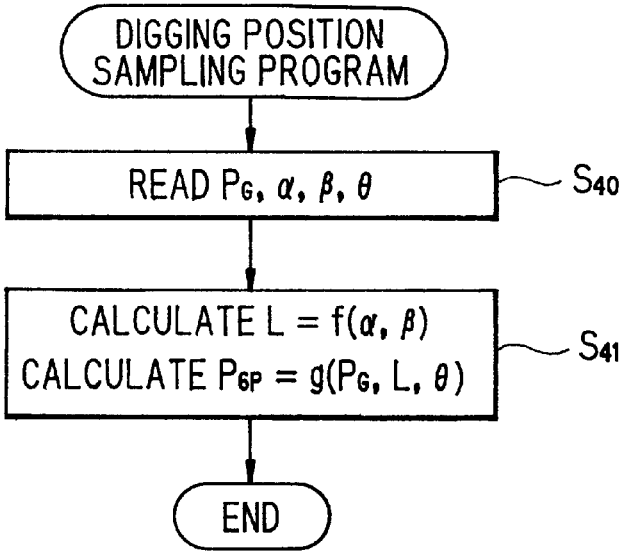
FIG. 8 is a still further flow chart illustrating a still further operation of the system shown in FIG. 1.

Here, the above-described digging position $P_{6P}$ is obtained by performing the digging position sampling program 233*c* shown in FIG. 8. Namely, CPU 232 reads a signal $P_G$ from GPS 20, a signal θ from the magnetic direction sensor 21, and signals α,β from the boom angle sensor 18 and arm angle sensor 19 (step $S_{40}$ shown in FIG. 8); computes a horizontal distance L between the point of connection of the boom 4 on the pivot cab 2 by using a horizontal distance (already known) between the center line 2C of revolving motion of the hydraulic shovel and the point of connection of the boom 4 on the pivot cab 2, and the angles α,β; and then computes the digging position (the position of the hinge 6*p* of the bucket) $P_{6P}$ on the basis of the previously-read signal $P_G$, the computed distance L and the direction θ (step $S_{41}$).

Upon an elapsed time of 10 msec since the completion of the processing in step $S_{29}$, the load pressure sampling program is executed again. Since the crowd flag $F_C$ has already been turned on in step $S_{29}$ of the preceding processing, this ON state of the crowd flag is determined in step $S_{26}$ and the processing advances to step $S_{24}$ via steps $S_{22}$,$S_{23}$. As the crowd flag $F_C$ is ON, this ON state is determined in step $S_{24}$ and the processing advances to step $S_{30}$. In step $S_{30}$, CPU 232 adds "1" to the count value $C_{TL}$ of crowding operation time and also adds a current detection value (load pressure) of the pressure sensor 17 to an integrated value of load pressures until that time (in this case, "0" because the digging is the first digging). The routine then advances through step $S_{25}$ so that the processing is ended. This processing is executed at intervals of 10 msec during the digging operation, and in each execution, "1" is added to the count value $C_{TL}$ of crowding operation time and the load pressure is integrated.

Upon completion of the digging operation, the operator operates the operating lever 13 in the dumping direction. This operation is determined by the processing in step $s_{22}$ subsequent to the processings in steps $S_{20}$,$S_{21}$. CPU 232 then determines whether or not the dump flag $F_D$ is ON (step $S_{31}$). Because the operating direction of the bucket has been just changed over to the dumping direction, the dump flag $F_D$ is in the OFF state. It is therefore determined whether or not the dumping-operation-determining count value $C_D$ has reached the above-mentioned value $C_{CO}$ (step $S_{32}$). As the value $C_{CO}$ has not been reached, "1" is added to the dumping-operation-determining count value $C_D$ (step $S_{33}$). The routine then advances through steps $S_{24}$,$S_{25}$, whereby the processing is ended. Similarly to the case of the operation in the crowding direction, this processing is repeated until $C_D$ becomes equal to $C_{CO}$ ($C_D$=$C_{CO}$; until an operation in the dumping direction is confirmed). Upon confirmation of $C_D$=$C_{CO}$ in step $S_{32}$, CPU 232 then turns on the dump flag $F_D$ and turns off the crowd flag $F_C$ (step $S_{33}$). Subsequent to the processing in step $S_{24}$, the ON state of the dump flag $F_D$ is determined in step $S_{26}$, and it is determined whether or not the digging number n has been updated (step $S_{34}$). Since the digging number n has been updated as a result of the addition of "1" in step $S_{29}$ in this case, CPU 232 performs the processing of step $S_{35}$.

By the processing in step $S_{35}$, the following computations are performed:

[1] a count value $C_{TL}(n-1)$ of crowding operation time up to the preceding digging is subtracted from the current integrated value $C_{TL}(n)$ of count values $C_{TL}$ of crowing operation time to obtain a current count value $\Delta C_{TL}(n)$ of crowding operation time;

[2] the current count value $\Delta C_{TL}(n)$ of crowding operation time is multiplied by the interval (10 msec) of repeated executions of the load pressure sampling program 233*c* to obtain a current digging time $\Delta T_L$;

[3] the integrated value $P_D(n-1)$ of load pressures up to the preceding digging is subtracted from the current integrated value $P_D(n)$ of load pressures to obtain a current load pressure $\Delta P_D(n)$; and

[4] the current load pressure $\Delta P_D(n)$ is divided by a current count value $\Delta C_{TL}(n)$ of crowding operation time to obtain a current average load pressure $P_A$.

The results of the computations are outputted as data to the radio transmitter/receiver 24. The radio transmitter/receiver 24 wirelessly transmits the thus-inputted data to the computer 30 at the mine management office B.

Figure 9:
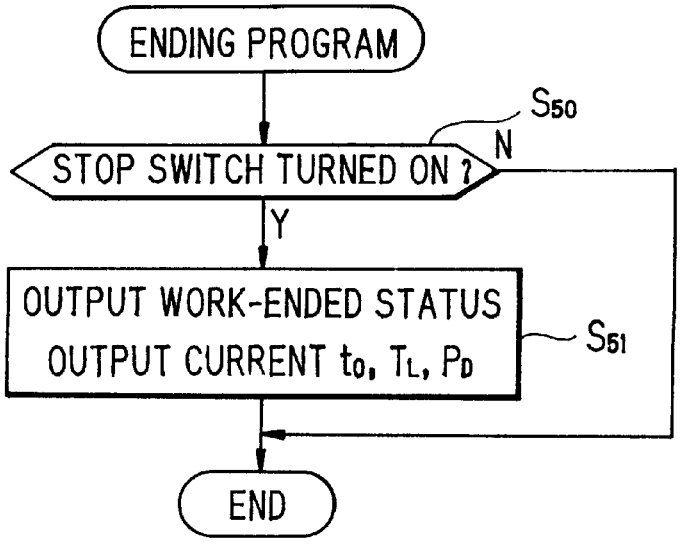
FIG. 9 is a still further flow chart illustrating a still further operation of the system shown in FIG. 1.

At the hydraulic shovel, the above-described processing is repeated by the processor 23 whenever the bucket 6 is operated in the crowding direction. Upon completion of each bucket operation in the crowding direction, the above-mentioned data are hence transmitted to the computer 30 at the mine management office B. Upon completion of digging work in one of the lots, the operator turns on the stop switch of the start/stop switch 22 so that the ending program 233*d* shown in FIG. 9 is executed. In other words, CPU 232 watches whether or not the stop switch 22 has been turned on (step $S_{50}$). When the stop switch is determined to have been turned on, CPU 23 outputs a work-ended status and also outputs a current time $T_o$, an integrated value $T_L$ of crowding operation time and an integrated value $P_D$ of load pressures, both to the radio transmitter/receiver 24 (step $S_{51}$), whereby the processing is ended.

The foregoing is the processing on the side of the excavator, and on the side of the mine management office B, the following processing is performed for data which are transmitted from the side of the excavator upon each digging operation.

Figure 10:
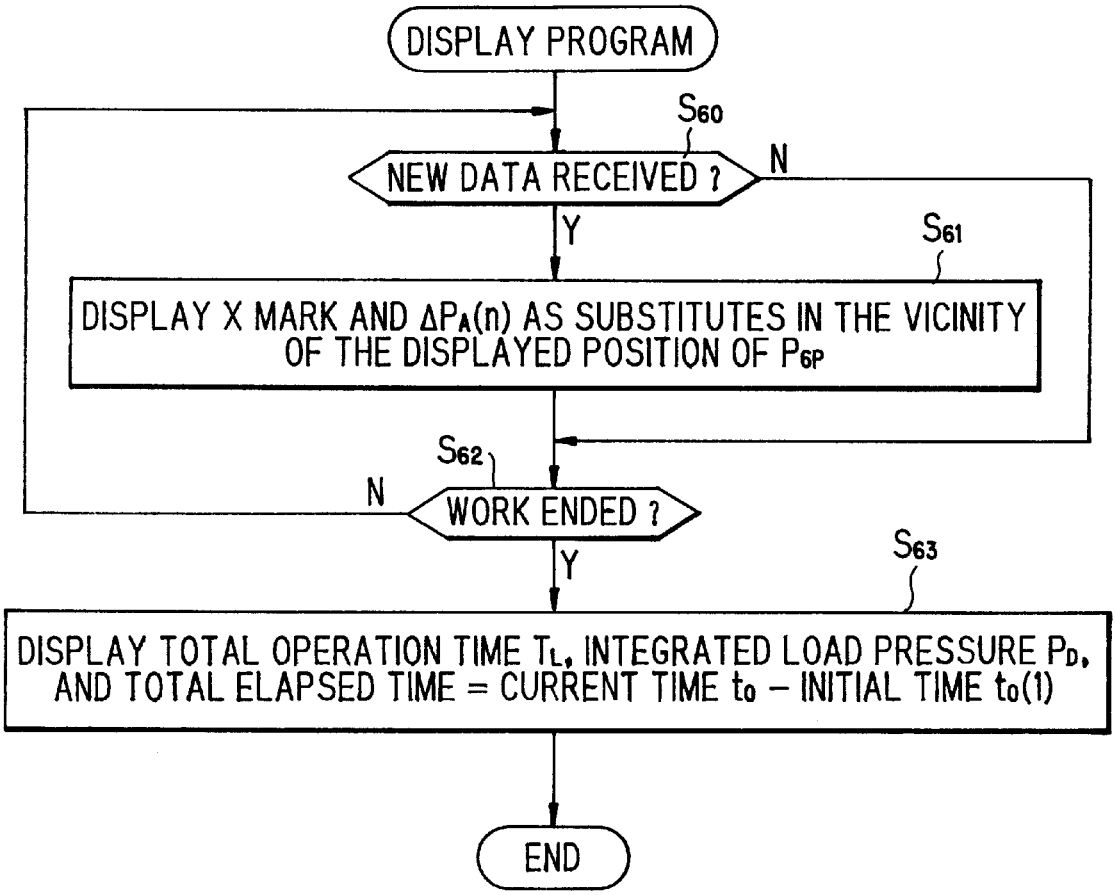
FIG. 10 is a still further flow chart illustrating a still further operation of the system shown in FIG. 1.

Before initiation of digging of each digging lot by the hydraulic shovel, the computer 30 displays the map of the digging lot and explosive-planted positions on the screen of the display 32 on the basis of the blasting data 303*a*. In this state, the display program 303*c* shown in FIG. 10 is repeatedly executed, and CPU 302 determines whether or not new data have been transmitted from the side of the excavator (step $S_{60}$). Upon determination of receipt and input of data at the radio transmitter/receiver 31 from the side of the excavator, CPU 303*c* writes inputted digging position data $P_{6P}$ and a load pressure $\Delta P_D(n)$ of the current digging in the load pressure data area 303*b*, displays a mark X on the screen at a position corresponding to the digging position data $P_{6P}$, and also displays the load pressure $\Delta P_D(n)$ of the current digging in the vicinity of the mark X (step $S_{61}$). It is then determined whether or not the stop switch has been turned on (step $S_{62}$). If the stop switch has not been turned on, the routine returns to the processing in step $S_{60}$. Whenever new data are inputted, a mark X and a load pressure are stored and displayed.

Figure 11:
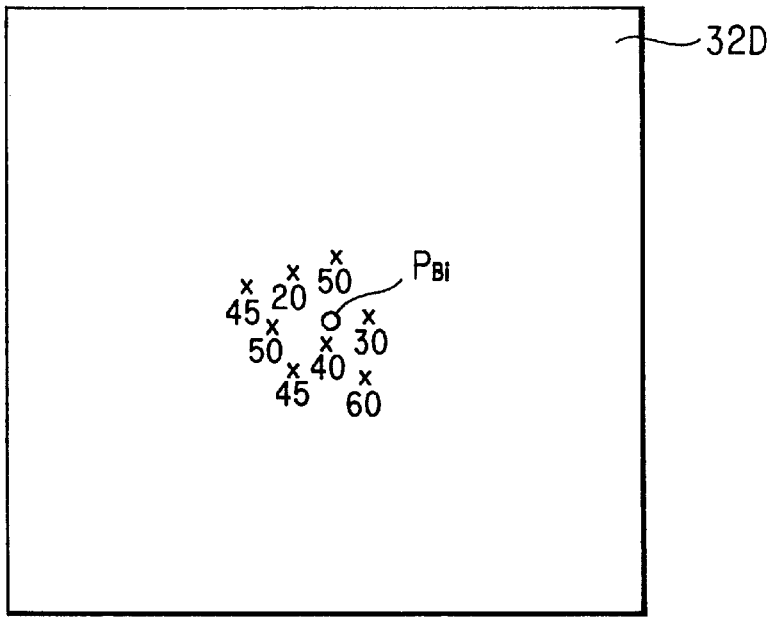
FIG. 11 is a partly enlarged front view of a screen of a display.

FIG. 11 is the enlarged fragmentary front view of the screen of the display. In this diagram, sign 32D indicates the screen of the display 32. $P_{Bi}$ indicates one of the explosive-planted positions, and digging positions and load pressures around the explosive-planted position $P_{Bi}$ are indicated by marks X and numerals, respectively. In this case, each load pressure is not an actual load pressure but is indicated as a corresponding level out of 0 to 100 levels into which actual load pressures are divided. Display of other positions is effected likewise.

When the digging work is completed and the stop switch is turned on by the operator, CPU 302 determines it in step $S_{62}$, and displays an integrated value $T_L$ of crowding operation time and an integrated value $P_D$ of load pressures, both transmitted following step $S_{51}$ shown in FIG. 9, and also subtracts from the current time $t_o$ a time $t_o(1)$ at the time of the initiation of the digging work and displays a total working time required for the digging.

Figure 12:
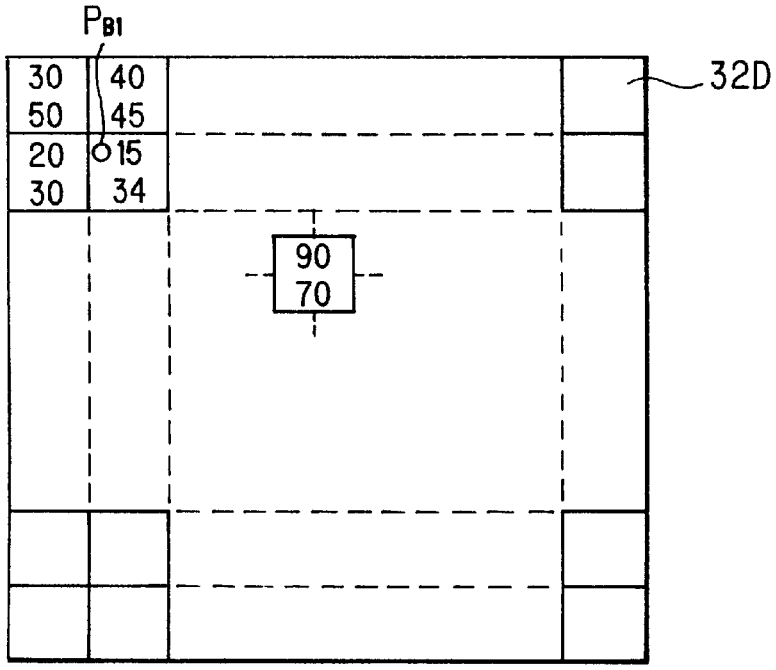
FIG. 12 is a front view of the screen, illustrating another example of display on the display.

FIG. 12 is the front view of the screen of the display, illustrating another example of display. In this diagram, sign 32D indicates the same screen as that depicted in FIG. 11. Further, sign $P_{B1}$ indicates a blasting position. In this example of display, a lot is subdivided into smaller lots (for example, 5 m squares), and with respect to each of these subdivided lots, a digging time and an average value of load pressures (levels) are displayed. In this case, the display program 303*c* should of course be added with a step for computing the digging time and the average value of load pressure levels.

In the example of display shown in FIG. 11 and FIG. 12, the load pressures are displayed by numerical values by way of example. It is however possible to display each load pressure or load pressure level in a corresponding color by dividing load pressures or load pressure levels into plural ranges in accordance with their values and assigning different colors to the individual ranges, for example, in such a way that a high load pressure range is indicated by red, a low load pressure range is indicated by blue and an intermediate load pressure range is indicated by green.

As has been described above, according to this embodiment, bucket-digging positions and load pressures in the crowding direction at these positions are collected on the side of the excavator in the digging of earth after blasting, these digging positions and load pressures are transmitted to the mine office, and at the mine office, the digging positions and the load pressures or load pressure levels are displayed on the map of the blasted lot and the blasted positions on the basis of the transmitted data. With reference to these information, the blasting planner can therefore perform blasting of the next lot more properly. Described specifically, with reference to the explosive-planted positions, the digging positions and the load pressures or load pressure levels on the map, the blasting planner determines inter alia whether or not the amount of the blasting explosive was too little at each position where the load pressure was too high, whether or not another geological survey is needed when the amount of the explosive is not considered to be little, or whether or not the amount of the explosive should be reduced when the load pressure is low. This makes it possible to perform the blasting of the next lot properly. Further, the number of dump trucks to be used is taken into consideration. When many trucks are available for use, the waiting time of each dump truck can be minimized by lowering load pressures and making the digging time shorter. From this viewpoint, it is also possible to make a determination in view of load pressures obtained by a measurement according to this embodiment as to whether or not the amount of explosive should be increased (load pressures should be lowered). When the number of dump trucks available for use is small in contrast, the overall transportation work cannot be inconvenienced even when the digging time becomes somewhat long. From this viewpoint, the amount of explosive can be determined in view of the load pressures so obtained. Concerning the excavators, load pressures are displayed from time to time so that, if there are many positions of high load pressures, one or more excavators may added to smoothly perform the work.

If a digging time is referred to, unskillfulness of the operator or the occurrence of a mechanical trouble may be gathered when the digging time is long in spite of low load pressures. Further, a display of load pressures in colors makes it possible to determine with a single glance whether the overall blasting was proper or improper. In addition, it is also possible to determine, from the display of an integrated value $T_L$ of crowding operation time and a total working time required for digging up to an integrated value $P_D$ of load pressures, whether or not the overall blasting is proper or improper.

A description will next be made about the second embodiment of the present invention.

Figure 13:
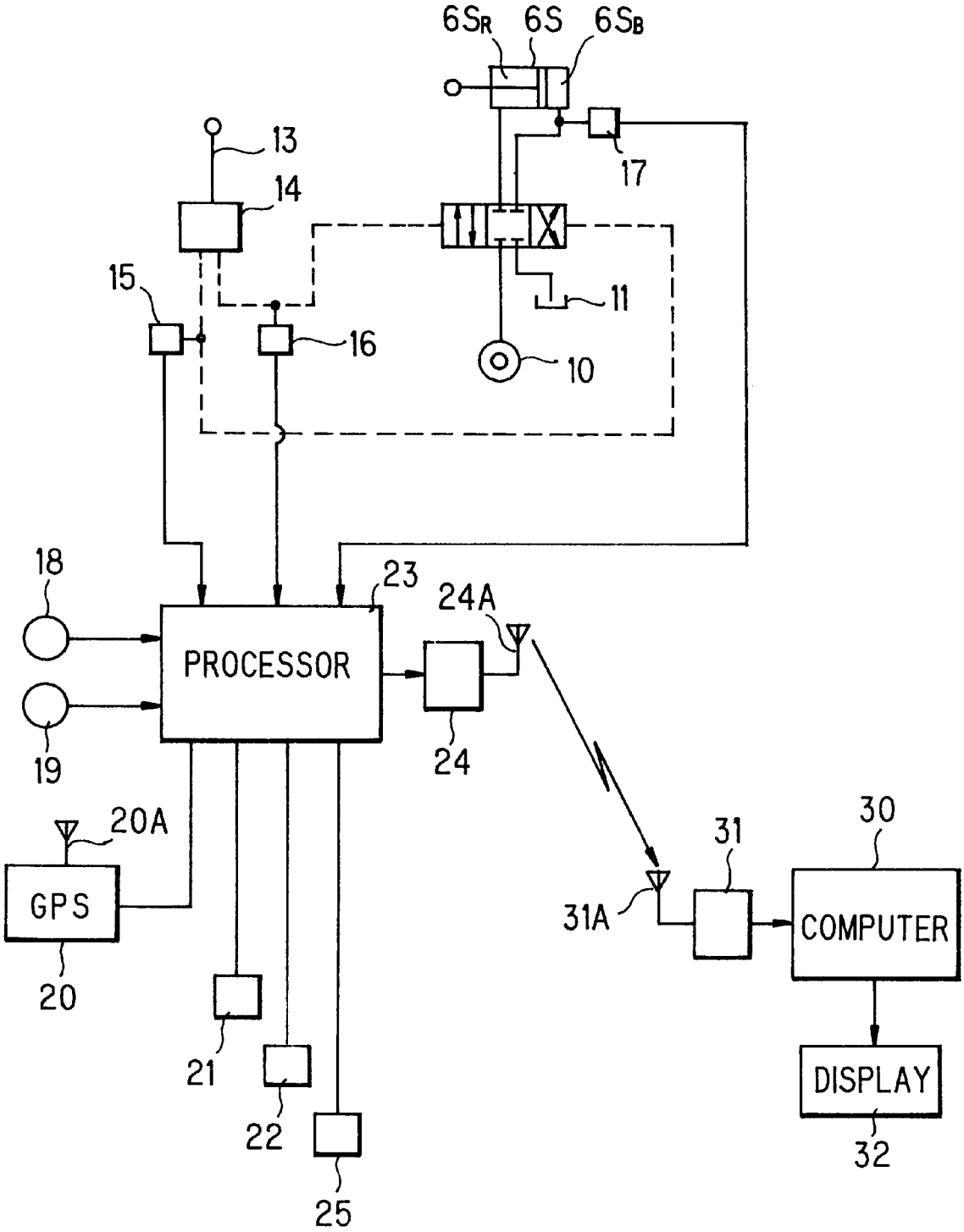
FIG. 13 is a block diagram of a measuring and display system according to a second embodiment of this invention for loads applied upon digging blasted earth.

FIG. 13 is the block diagram of the measuring and display system according to the second embodiment of the present invention for loads applied upon digging blasted earth. In this diagram, elements of structure identical or equivalent to the corresponding elements shown in FIG. 1 are identified by like reference signs, and their description is omitted. Operations of the bucket in the crowding direction were all referred to as "digging" in the above-described first embodiment, whereas "digging" operations will be classified further depending on the actual work in this embodiment. Namely, it is the common practice in digging work to employ such work procedures that, when the number of trucks is small, blasted earth is dug to heap the earth at one place and the thus-heaped earth is loaded on each dump truck upon its arrival. In this embodiment, "digging" operations are classified into digging of blasted earth (digging directly associated with an actual load) and digging upon loading the earth on each dump truck. This classification is conducted by a work step input switch 25. The work step input switch 25 is composed of a DIG switch and a LOAD switch. The DIG switch is turned upon digging blasted earth, whereas the LOAD switch is turned on upon digging the earth for loading it on each dump truck. The construction other than the work step input switch 25 is the same as the construction illustrated in FIG. 1 although there are some differences in the processing steps by the processor 23 and the computer 30.

Figure 14:
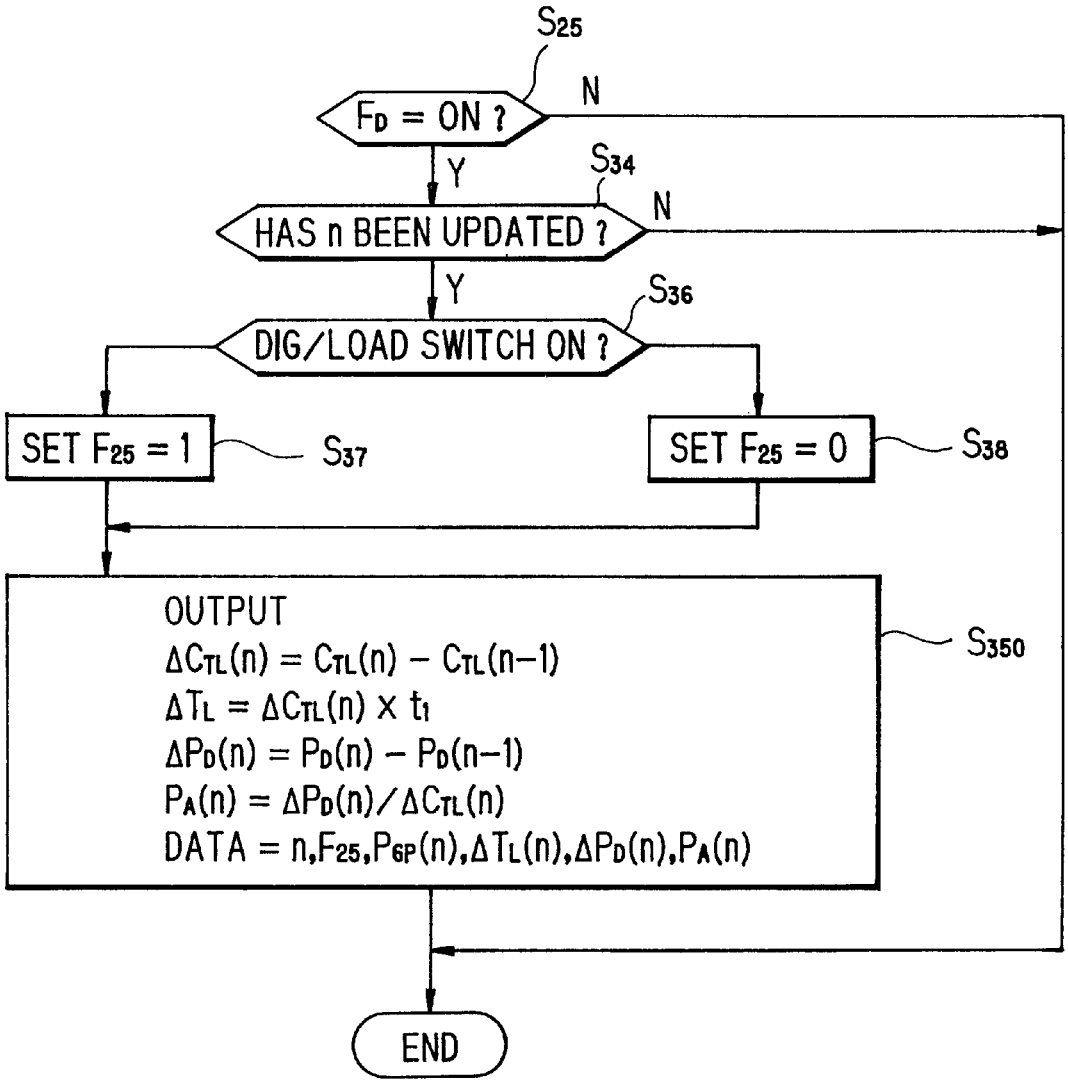
FIG. 14 is a flow chart illustrating an operation of the system shown in FIG. 13.
Figure 15:
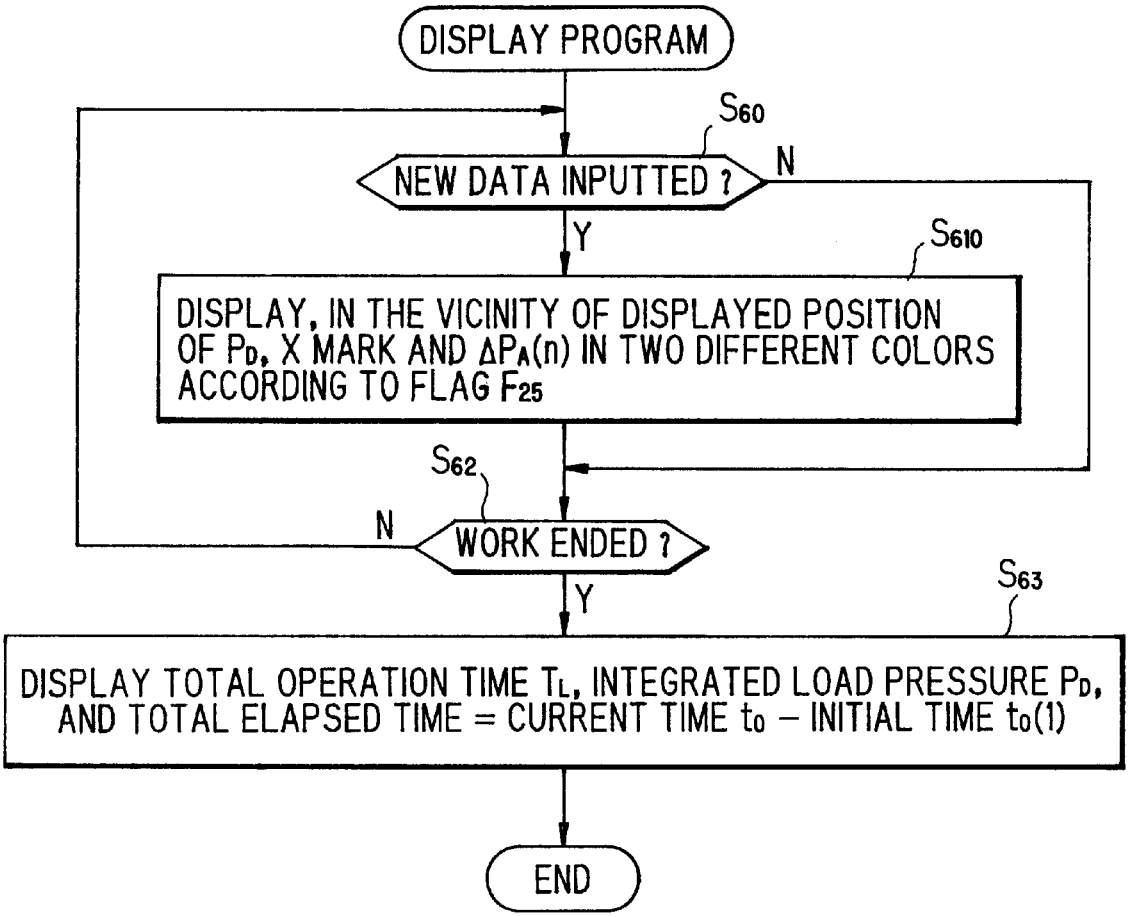
FIG. 15 is a flow chart illustrating an operation of the system shown in FIG. 13.

Operations of this embodiment will next be described with reference to the flow chart shown in FIG. 14 and FIG. 15. An operator of a hydraulic shovel turns on the DIG switch upon digging blasted earth or the LOAD switch upon digging the earth for loading it on a dump truck. In this state., a load pressure sampling program is executed as in the preceding embodiment. Namely, an operation of the operating lever 13 in the crowding direction is confirmed, and a count value $C_{TL}$ of crowding operation time and a bucket load pressure $P_B$ are added. When the operating lever 13 is next operated in the dumping direction, this operation is confirmed. In the preceding embodiment, operations up to this point were performed in step $S_{20}$ to step $S_{34}$, and processing for the computation and output of the individual data was then immediately performed in step $S_{35}$. In this embodiment, operations up to step $S_{34}$ are the same as those in the preceding embodiment but the subsequent operations differ.

Described specifically, when it is determined in step $S_{34}$ that the digging number n has been updated, a determination is next made as to whether the DIG switch or the LOAD switch is ON in the work step switch 25 (step $S_{36}$ shown in FIG. 14) A flag $F_{25}$ for the work step input switch 25 is set at "1" when the DIG switch is ON, (step $S_{37}$) but the flag $F_{25}$ for the work step input switch 25 is set at "0" when the LOAD switch is ON (step $S_{38}$), and the routine then advances to step $S_{350}$. In step $S_{350}$, the same computation as that in step $S_{35}$ in FIG. 7 is performed to obtain the same individual data, and the data of the flag $F_{25}$ is collected and is outputted together with the individual data to the radio transmitter/receiver 24.

At the computer 30, on the other hand, a display program is executed as in the preceding embodiment. When new data is determined to have been inputted (step the thus-inputted digging position data $P_{6P}$ and current digging load pressure $\Delta P_D(n)$ are written together with the data of the flag $F_{25}$ in the load pressure data area 303*b*, and further, a mark X is displayed at a position on the screen, said position corresponding to the digging position data $P_{6P}$ and the current digging load pressure $\Delta P_D(n)$ is displayed in the vicinity of the mark (step $S_{610}$). This display of the mark X and the load pressure data is performed in the same manner as in the preceding embodiment, but in this embodiment, the mark X and the load pressure data are displayed in different colors in accordance with the data of the flag $F_{25}$. Processings in steps $S_{62}$ and $S_{63}$, which follows the aforementioned processing, are the same as the corresponding processings in the preceding embodiment.

Figure 16:
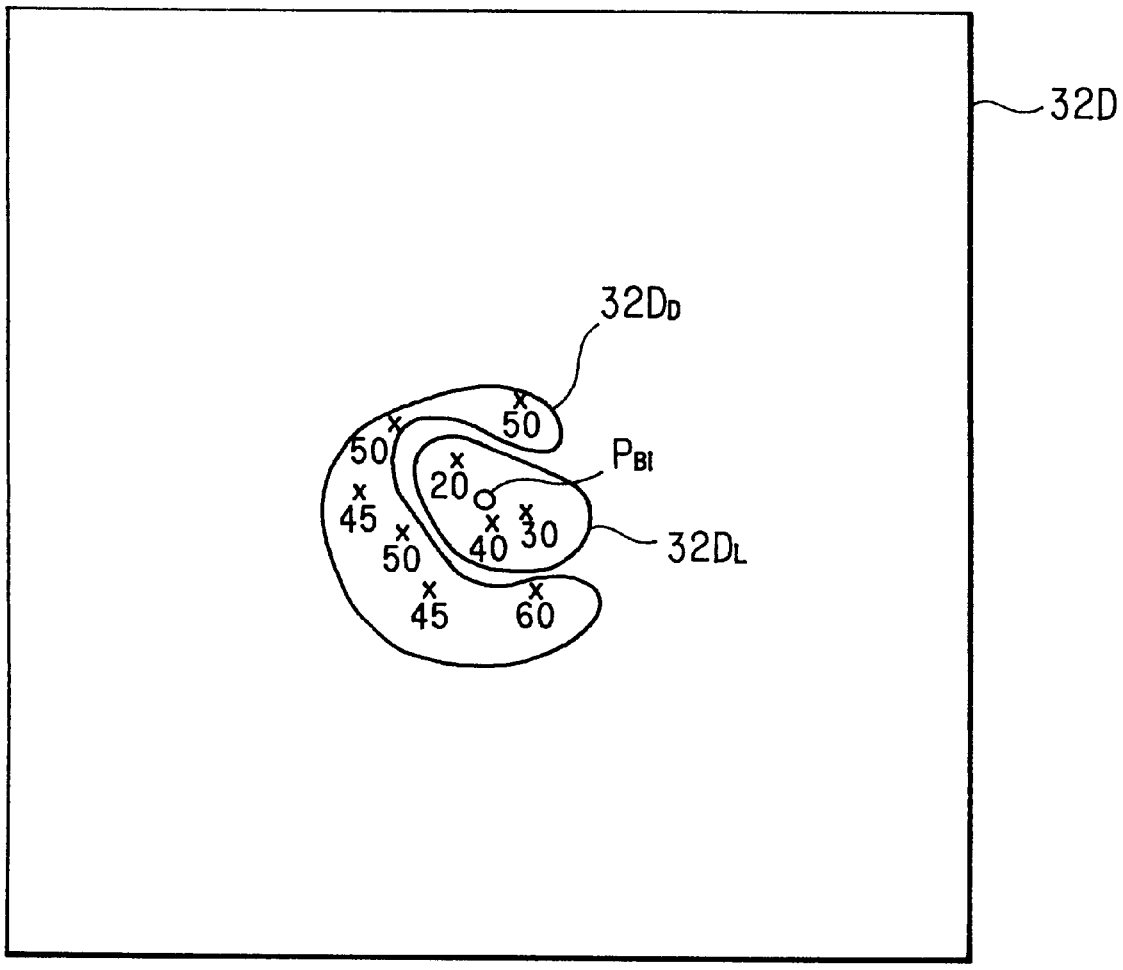
FIG. 16 is a partly-enlarged front view of a screen of the display system.

FIG. 16 is the enlarged fragmentary front view of the screen of the display. In this diagram, sign 32D indicates the screen of the display 32. $P_{Bi}$ indicates one of the explosive-planted positions, and digging positions and load pressures around the explosive-planted position $P_{Bi}$ are indicated by marks X and numerals, respectively. In this case, each load pressure is not an actual load pressure but is indicated as a corresponding level out of 0 to 100 levels into which actual load pressures are divided. Display of other positions is effected likewise. In this embodiment, digging positions and load pressure levels are displayed in different colors depending on the digging of blasted earth or the digging for loading. Around the position $P_{Bi}$, digging positions and load pressure levels when the data of the flag $F_{25}$ is "1" (upon digging blasted earth) and digging positions and load pressure levels when the data of the flag $F_{25}$ is "0" (upon digging for loading) are therefore observed in two groups divided in different colors. In the diagram, sign 32$D_D$ indicates the group upon digging the blasted earth and sign 32$D_L$ designates the group upon digging for loading.

Incidentally, this display is not limited to that shown in FIG. 16, but can be in the form of the display shown in FIG. 12. In such a case, small lots are displayed with a time and a load pressure in different colors in each lot.

In addition to the advantageous effects of the preceding embodiment, this embodiment can bring about an additional advantageous effect in that the proper/improper determination of blasting can be conducted more easily and accurately because load pressures are displayed by classifying them into load pressures upon digging blasted earth and those upon digging for loading.

Figure 17:
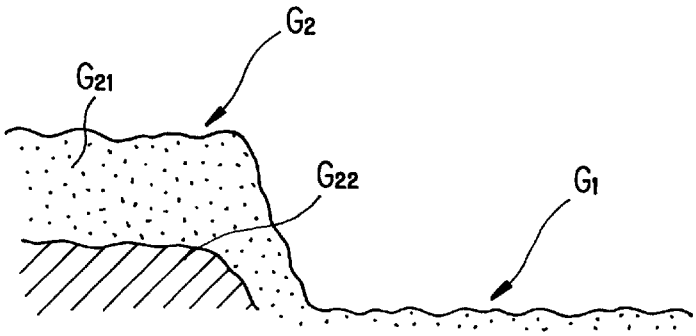
FIG. 17 is a cross-sectional view of a blasted bottom of a pit.
Figure 18A:
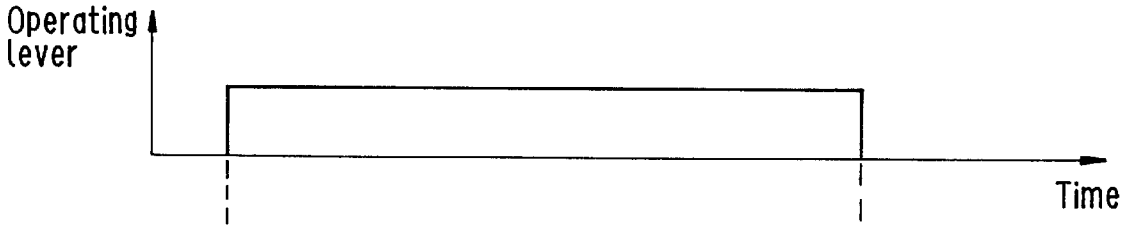
FIGS. 18A & 18B are a timing chart illustrating an operation of a third embodiment.
Figure 18B:
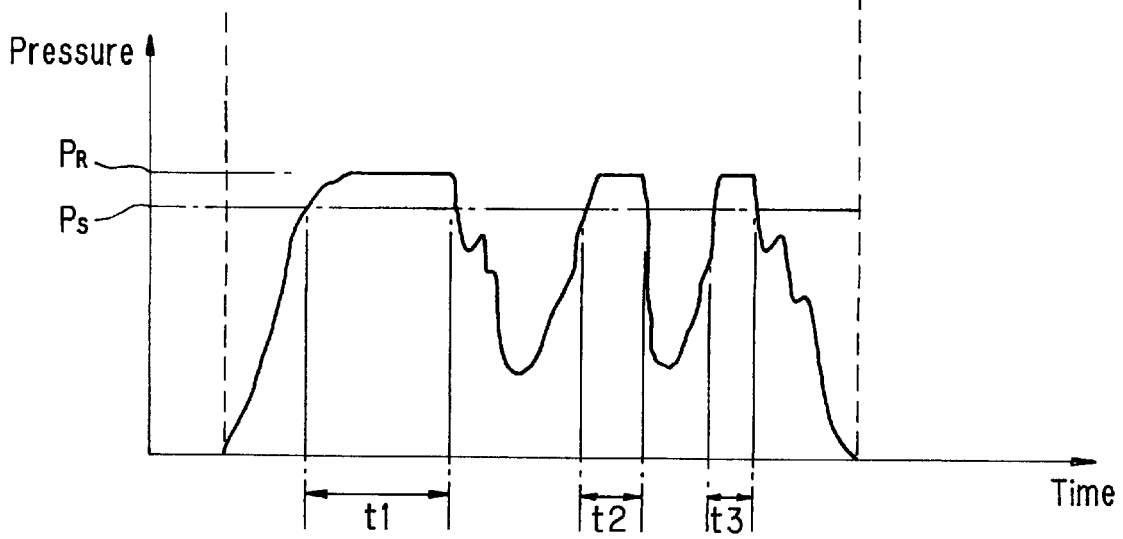

A description will next be made about the third embodiment of the present invention. The overall construction of this embodiment is substantially the same as the construction illustrated in FIG. 1 except that the pressure switch 16 is omitted and the processor 23 and the computer 30 perform different processing steps. FIG. 17 and FIGS. 18A & 18B diagrammatically illustrate a measurement according to this embodiment to determine a load applied upon digging blasted earth. FIG. 17 is the cross-sectional view of a blasted bottom of a pit, and FIGS. 18A & 18B is the timing chart showing an operation of this embodiment.

In FIG. 17, sign $G_1$ indicates a digging-finished bottom in the blasted bottom of the pit and sign $G_2$ indicates an unexcavated earth on the blasted bottom of the pit. In the unexcavated earth $G_2$, sign $G_{21}$ indicates a portion broken loose by blasting and sign $G_{22}$ indicates a portion not broken fully loose in spite of the blasting. After completion of the digging at the digging-finished bottom $G_1$, a hydraulic shovel performs digging of the adjacent unexcavated earth $G_2$ while using the digging-finished bottom $G_1$ as a foundation. Incidentally, blasting is conducted by making holes in a bottom of a pit and then setting explosives there. The earth is therefore broken to a substantial depth. Nonetheless, the breakage of the earth in a deep section becomes insufficient compared with that of the earth in a section close to the surface. Whether the blasting was proper or improper is determined depending on how many sections of insufficient earth breakage exist. This embodiment is therefore to prepare data, which is to be transmitted to the mine management office B, by collecting only digging loads in sections of insufficient earth breakage.

An operation of this embodiment will hereinafter be described with reference to the timing chart shown in FIGS. 18A & 18B. FIG. 18(*a*) is the diagram illustrating an operation of the operating lever, in which time is plotted along the abscissa and the stroke of the operating lever is plotted along the ordinate. On the other hand, FIG. 18(*b*) is a diagram illustrating pressures in the bottom compartment 6$S_B$ of the bucket cylinder 6S, in which time is plotted along the abscissa and pressure is plotted along the ordinate. The start switch of the start/stop switch 22 is turned on upon initiation of digging, and a digging position under digging is calculated by the same method as in the first embodiment. When it is determined from a signal $L_C$ that the operating lever 13 has been operated in the crowding direction (this determination method is the same as the determination method in the first embodiment), the processor 23 receives detection pressures $P_B$ of the pressure sensor 17 and compares them with a preset pressure $P_S$. When the detection pressures $P_B$ are equal to or higher than the preset pressure $P_S$, their times or durations are measured (these times are indicated by $t_1$,$t_2$,$t_3$ in the diagram) and the number of the pressures (3 times in the case illustrated in the drawing) is counted. Incidentally, sign $P_R$ indicates a relief pressure in the diagram. These times are summed, and are outputted together with the number of the pressures to the radio transmitter/receiver 24 and are then transmitted to the computer 30.

The computer 30 stores the thus-transmitted data in the load pressure data area 303*b*, and in accordance with a display program, displays the digging position by a mark X on the screen of the display 32 and also displays the above-described total time or number or both of them in the vicinity of the mark X. When the stop switch is turned on, a total operation time, a total elapsed time, an integrated value of the above-described total times, or an integrated value of the above-described numbers is displayed on the screen.

This embodiment can bring about the same advantageous effects as the preceding embodiments.

Figure 21:
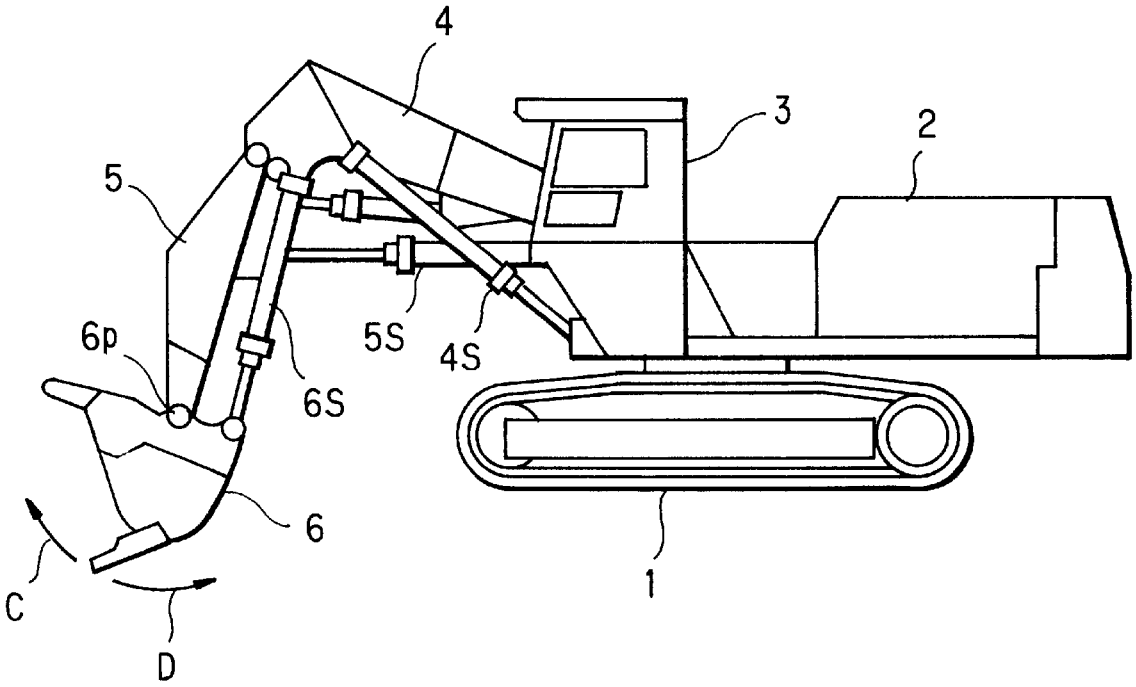
FIG. 21 is a side view of a hydraulic shovel.

In the above description of each of the embodiments, the loader-type hydraulic shovel shown in FIG. 21 was described as an excavator by way of example. Needless to say, a back-hoe-type hydraulic shovel can also be used. Further, whether blasting or the like is proper or improper can be estimated to a certain extent by depending upon only data of digging loads without using a display. The start/stop switch may be arranged on the side of the mine management office instead of installing it on the side of the excavator, and the data of the start/stop switch may be transmitted from the side of the mine management office to the side of the excavator by the radio transmitter/receiver. In addition, it is also possible to use a pressure sensor in place of the pressure switch for the detection of an operation of the operating lever, to input a detection signal from the pressure sensor to the processor, and then to determine that the operating lever has been operated when the pressure has reached a predetermined value or higher. Setting of the predetermined value at an appropriate value can obviate the processing for the confirmation of an operation of the operating lever at the processor.

Concerning the digging positions, the example making use of GPS was described. It is also possible to use a laser projector and a reflecting mirror in place of GPS. The reflecting mirror mounted on the excavator is tracked from the mine management office. The relative position of the excavator from the mine management office can then be measured as a digging position. As a further example, a digging position was also calculated by using a boom angle and an arm angle. Since the positions of the boom and arm in digging are not significantly different from the positions of the boom and arm in loading, a predetermined distance from the pivot of the boom may be chosen in advance for use in the calculation of each digging position without relying upon a boom angle and an arm angle.

Capability of Exploitation in Industry

As has been described above, the present invention detects a bottom pressure of a bucket cylinder in a crowding operation period of a bucket of an excavator which is in a digging operation of earth after blasting, detects the digging position by the excavator, and then shows both of them on a display. This makes it possible to perform proper blasting.

What is claimed is:

1. A measuring system for loads applied upon digging blasted earth, comprising crowding operation detecting means for detecting a crowding operation of a bucket of an excavator which is in a digging operation of earth after blasting; and pressure detection means for detecting, as a digging load, a bottom pressure of a bucket cylinder of said excavator upon detection of said crowding operation by said crowding operation detecting means.

2. The measuring system according to claim 1, further comprising digging time detection means for detecting digging time of said excavator.

3. The measuring system according to claim 2, further comprising:

digging position detecting means for detecting a digging position by said excavator; and a display system comprising display means for displaying said digging load detected by said pressure detection means or a value or color corresponding to said digging load and said digging position detected by said digging position detecting means.

4. The measuring system according to claim 3, wherein said display means stores blasting positions and displays said blasting positions as desired.

5. The measuring system according to claim 1, further comprising:

digging position detecting means for detecting a digging position by said excavator; and a display system comprising display means for displaying said digging load detected by said pressure detection means or a value or color corresponding to said digging load and said digging position detected by said digging position detecting means.

6. The measuring system according to claim 5, wherein said display means stores blasting positions and displays said blasting positions as desired.

7. A measuring system for loads applied upon digging blasted earth, comprising crowding operation detecting means for detecting a crowding operation of a bucket of an excavator which is in a digging operation of earth after blasting; loading step determination means for determining a loading step performed by said excavator; pressure detection means for detecting, as a digging load, a bottom pressure of a bucket cylinder of said excavator upon detection of said crowding operation by said crowding operation detecting means; and classification means for classifying said digging load, which has been detected by said pressure detection means, as said digging load in said loading step as determined by said loading step determination means or as a digging load in a step other than said loading step.

8. The measuring system according to claim 7, further comprising:

digging position detecting means for detecting a digging position by said excavator; and a display system comprising display means for displaying said digging load, which has been detected by said pressure detection means or a value or color corresponding to said digging load, while specifying whether said digging load or said value or color is one in said loading step or one in said step other than said loading step as determined by said loading step determination means, and said digging position detected by said digging position detecting means.

9. The measuring system according to claim 8, wherein said display means stores blasting positions and displays said blasting positions as desired.

10. A measuring system for loads applied upon digging blasted earth, comprising crowding operation detecting means for detecting a crowding operation of a bucket of an excavator which is in a digging operation of earth after blasting; and preset pressure detection means for detecting, as a digging load, a bottom pressure of a bucket cylinder of said excavator when said bottom pressure arises at least to a preset pressure while said crowding operation is being detected by said crowding operation detecting means.

11. The measuring system according to claim 10, further comprising load quantity detection means for determining the time or number of detections in each of which a pressure at least equal to said preset pressure is detected by said preset pressure detection means.

12. The measuring system according to claim 11, further comprising:

digging position detecting means for detecting a digging position by said excavator; and a display system comprising display means for displaying the time or number, which has been detected by said load quantity detection means, or a color corresponding to said time or number, and said digging position detected by said digging position detecting means.

13. The measuring system according to claim 12, wherein said display means stores blasting positions and displays said blasting positions as desired.

* * * * *